US006223822B1

(12) United States Patent
Jones

(10) Patent No.: US 6,223,822 B1
(45) Date of Patent: May 1, 2001

(54) DOWNHOLE SAMPLING TOOL AND METHOD

(75) Inventor: Timothy Gareth John Jones, Cottenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/447,474

(22) Filed: Nov. 23, 1999

(30) Foreign Application Priority Data

Dec. 3, 1998 (GB) ..... 98266557

(51) Int. Cl.[7] ..... E21B 49/08

(52) U.S. Cl. ..... 166/250.05; 166/264; 175/59; 73/61.41; 73/64.55; 73/19.01

(58) Field of Search ..... 166/100, 250.01, 166/250.05, 264; 175/40, 50, 59; 73/38, 61.41, 64.55, 19.01, 151, 152, 155; 250/258

(56) References Cited

U.S. PATENT DOCUMENTS 4,860,581 8/1989 Zimmerman et al. ..... 73/155
5,167,149 * 12/1992 Mullins et al. .
5,201,220 4/1993 Mullins et al. ..... 73/155
5,709,505 * 1/1998 Williams et al. .

* cited by examiner

*Primary Examiner*—Roger Schoeppel
(74) *Attorney, Agent, or Firm*—William L. Wang; William B. Batzer

(57) ABSTRACT

A sampling device for use downhole is provided comprising a hollow body (24) having a fluid inlet port (26) for fluid entry to the interior thereof, characterised by a gas extraction system (64) associated with the hollow body (24) and capable of securing as a non-volatile component at least part of a volatile component dissolved in a fluid entering the hollow body (24), the gas extraction system being removable therefrom to allow quantitative analysis of the non-volatile component to be undertaken. The gas extraction system (64) is placed in a supplementary chamber (46) having an inlet (50) and an outlet (52) which is attached to the hollow body and through which fluid passes to enter the hollow body. The gas extraction system is iron oxide to fix sulphur from volatile hydrogen sulphide for later analysis.

18 Claims, 3 Drawing Sheets

DOWNHOLE SAMPLING TOOL AND METHOD

Figure 1:
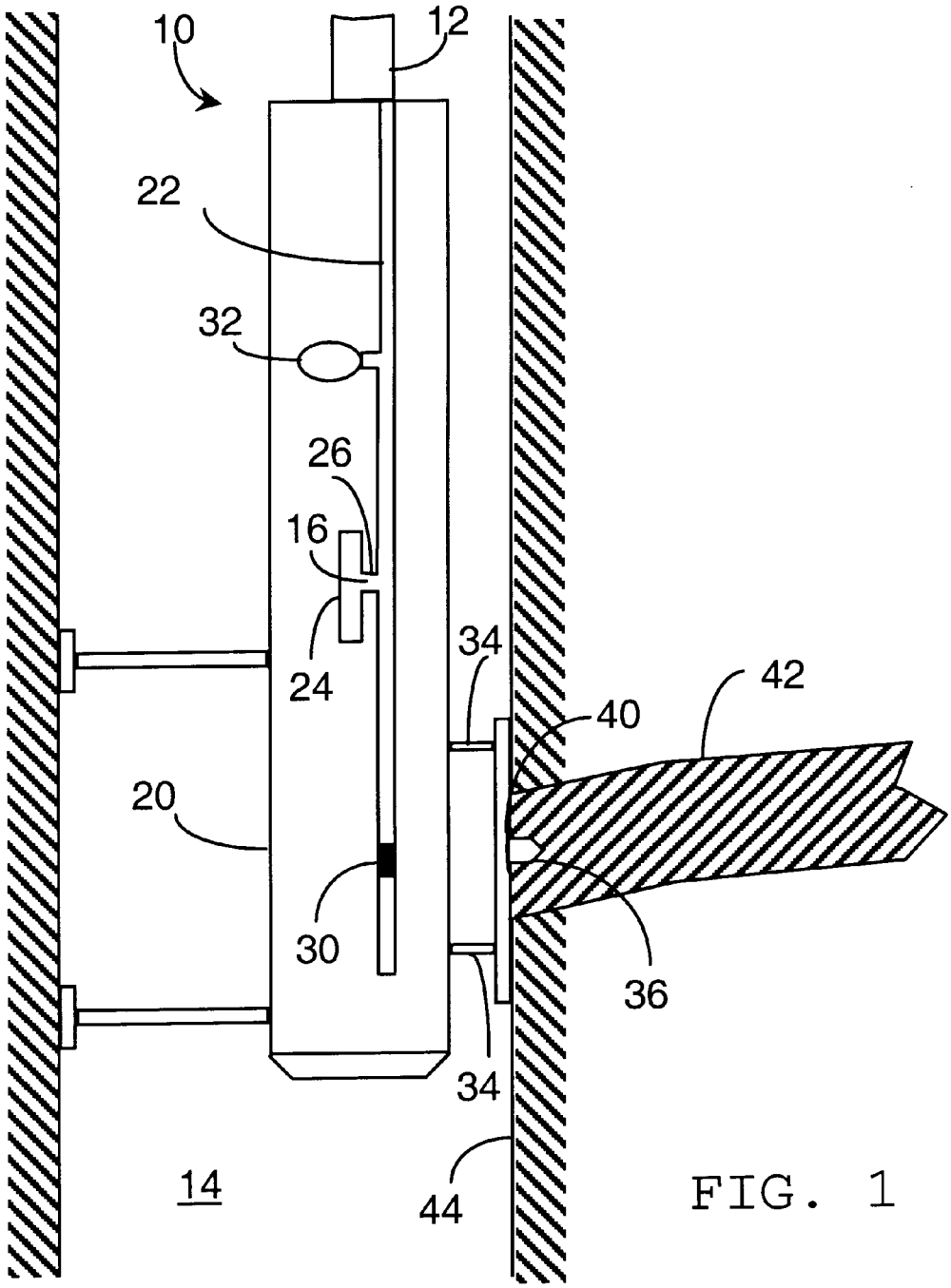

The invention relates to sampling apparatus for use downhole in acquiring samples of volatile components dissolved in downhole fluids, and to an associated method.

BACKGROUND OF THE INVENTION

Acquiring samples representative of downhole fluids is an important aspect of determining the economic value of an hydrocarbon formation. However where a volatile gas is dissolved in the fluid, the sample taken downhole may under-represent the proportion of the volatile gas within the fluid due to its reaction with the material from which sampling apparatus is made. This leads to an underestimate of the proportion of volatile gas.

There is a particular problem where hydrogen sulphide ($H_2S$) is dissolved in the fluid. $H_2S$ is highly corrosive and toxic and any underestimate of the proportion of this gas within the fluid can affect the economics of well production, as pipework will need to be replaced sooner than expected. Underestimate of the presence of corrosive gases such as $H_2S$ is having an effect on the economies of well production. In the last decade, it here has been observed that the proportion of $H_2S$ within hydrocarbon formations is increasing, partly as a result of accessing deeper formations.

Attempts to address this problem have included coating metal sampling apparatus with inert layers or the use of glass bottles to collect the samples of fluid. However these are relatively expensive and prevent the use of existing hardware. It is an objection of the present invention to provide apparatus and method for sampling downhole fluid which reduces the underestimation of volatile gases in hydrocarbons.

SUMMARY OF THE INVENTION

In accordance with one aspect of the invention, a wellbore fluid sampling device is provided comprising a main body to be suspended into a hydrocarbon well, said body having at least one fluid inlet port to engage with a wall of the well, at least one conduit guiding fluid into the main body and a gas extraction system associated with said at least one conduit for essentially exclusively separating from said wellbore fluid at least part of a predetermined volatile non-hydrocarbon component dissolved in said wellbore fluid entering said at least one conduit.

The gas extraction system is preferably a material capable of binding the volatile component of the wellbore fluid. However, in another variant of the invention, it is also envisaged to use a selectively permeable membrane or interface as extraction system.

The preferred volatile component to be extracted from the wellbore fluid is $H_2S$.

The method may further comprise retrieving the gas extraction system to the surface after sampling to permit analysis of the non-volatile components fixed in the system.

A preferred analysis of the material which the volatile component is bound to involves pyrolysis followed by mass spectrometry, by which the quantity of the non-volatile components fixed by the binding material can be determined.

According to a further aspect of the present invention, there is provided a method of quantitatively sampling volatile components dissolved in wellbore fluids, comprising the steps of lowering a sampling tool into a wellbore; bringing an inlet port of said tool into close contact with a subterranean formation; guiding said wellbore fluid from said subterranean formation into said tool; exposing said wellbore fluid to a gas extraction system for essentially exclusively separating from said wellbore fluid a predetermined volatile non-hydrocarbon component dissolved in said wellbore fluid; at least partially separating said volatile non-hydrocarbon component from said wellbore fluid; and storing said separated volatile component as non-volatile samples within said tool.

The gas extraction system may be placed within the hollow body, or in a supplementary chamber having an inlet and an outlet which is attached to the body and through which the fluid passes to enter the hollow body.

Where a supplementary chamber is used, preferably inlet and the outlet are provided with filters to prevent loss of binding material within the gas extraction system. Preferably the filters are formed from material which is inert to downhole fluids and to the binding material, and typically may comprise polytetrafluoroethylene (PTFE).

The hollow body has a fixed volume and as such the quantity of fluid sampled is known. This allows quantitative analysis of the volatile components to be performed. Thus a fluid can be sampled whilst downhole to ascertain the presence and percentage of selected volatile components in the fluid by selecting an appropriate binding material within the gas extraction system which material will preferentially react with the volatile component from the downhole fluid.

Such an sampling device allows gases dissolved within downhole fluids such as drilling fluid, oil or gas, to be fixed in a nonvolatile form within a binding material matrix for later analysis.

Typically the binding material is selected so as to secure $H_2S$ in non-volatile form.

For other gases which can occur downhole, such as carbon dioxide nitrogen, a binding material has to be chosen from those material which stabilises the respective gas. E.g., a strong alkali reactant for carbon dioxide.

The binding material may comprise one or combinations of the following materials, namely: metals, and in particular transition metals such as iron (Fe), molybdenum (Mo) and zinc (Zn), and metal oxides and in particular transition metal oxides such as iron oxide $Fe_3O_4$, zinc oxide ZnO and tungsten oxide $WO_3$.

Metals and metal oxides may be doped, for example copper oxide doped tin oxide $SnO_2$/CuO and gold doped tungsten oxide $W0_3$/Au.

Apart from metals and metal oxides, organic materials such as amines may be used, particularly where they exist as an organic solid at downhole temperatures.

Other compounds which may be used as the binding material include iron (III) EDTA complex in an aqueous alkaline solution for oxidising hydrogen sulphide to elemental sulphur and $R_1R_2XYR_3R_4$ compounds, where X and Y are carbon or nitrogen atoms and any two of the R groups contain electronegative groups, for example fumaronitrile.

By analysing the quantity of iron sulphide $FeS_2$ present for a known volume of downhole fluid sampled by the sampling device, the amount of $H_2S$ dissolved in the downhole fluid can be determined. Thus quantitative analysis of $H_2S$ can be achieved by choosing a binding material which reacts with $H_2S$ to form an inert sulphur containing compound.

The use of $Fe_3O_4$ as the binding material within the gas extraction system allows this to be done, since $Fe_3O_4$ fixes sulphur contained within $H_2S$ into an inert non-volatile form of iron sulphide according to the following equation:

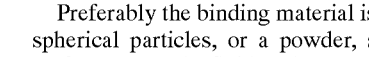

$$Fe_3O_4+6H_2S \rightarrow 3FeS_2+4H_2O+2H_2$$

The properties of the fluid and the temperatures experienced downhole will affect the choice of the binding material. Thus for example where high temperatures are present downhole, the binding material may desirably be tungsten oxide $WO_3$.

Preferably the binding material is in the form of generally spherical particles, or a powder, so as to present a large surface area to the fluids to be tested. Preferably the particles have a diameter in the range of 0.1 mm to 10 mm, and more preferably in the range of 0.1 mm to 1 mm, so as to ensure there is no significant pressure drop across the binding material within the device.

By making the gas extraction chamber compatible with existing downhole equipment, the tool according to the invention can be achieved by retrofitting to existing apparatus, and allows re-use of existing hardware so achieving cost savings.

The device may further comprise attachment means to secure it to a wireline so that it can be lowered downhole when sampling is required, and after sampling, raised again to surface.

These and other features of the invention, preferred embodiments and variants thereof, possible applications and advantages will become appreciated and understood by those skilled in the art from the following detailed description and drawings.

DRAWINGS

Figure 2:
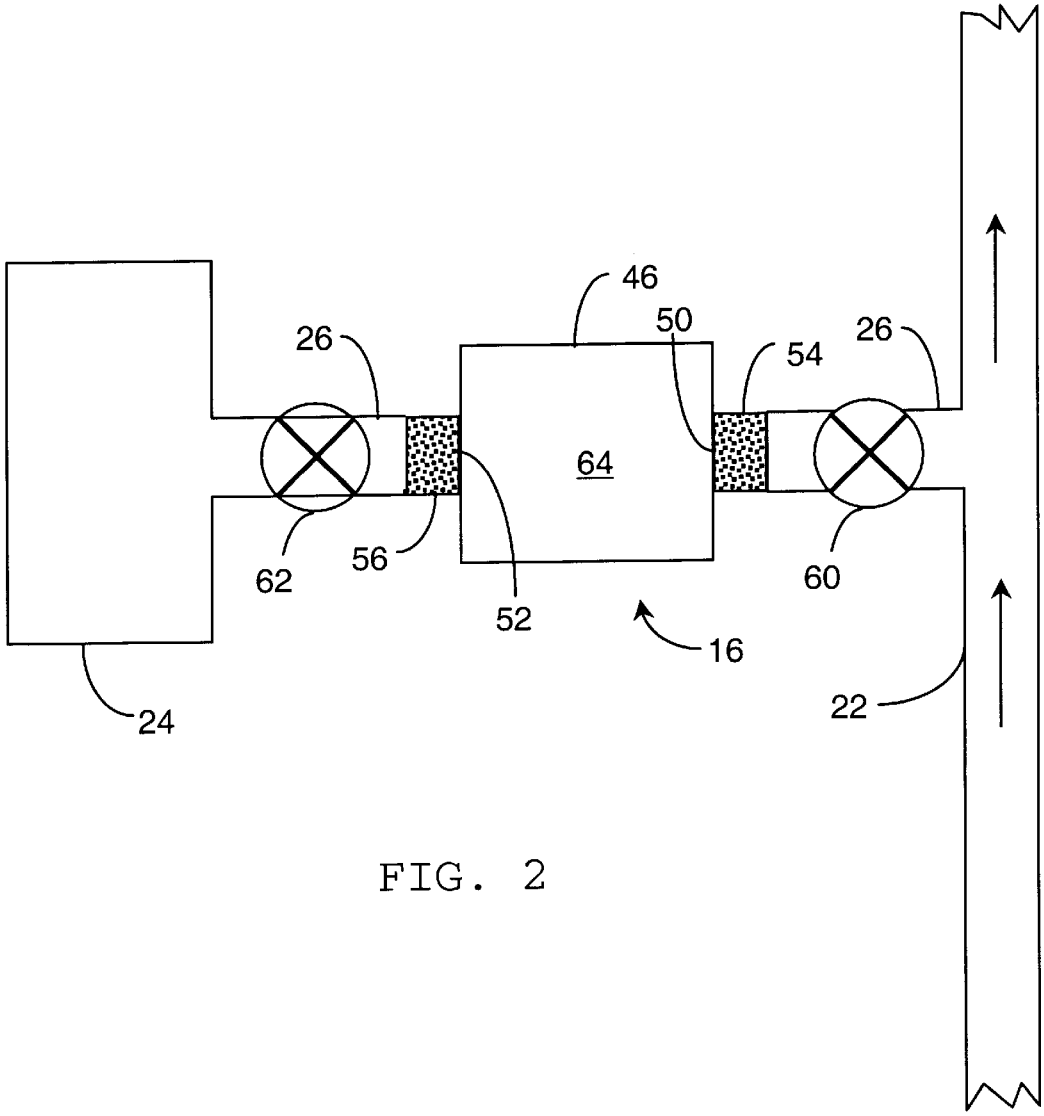
Figure 3:
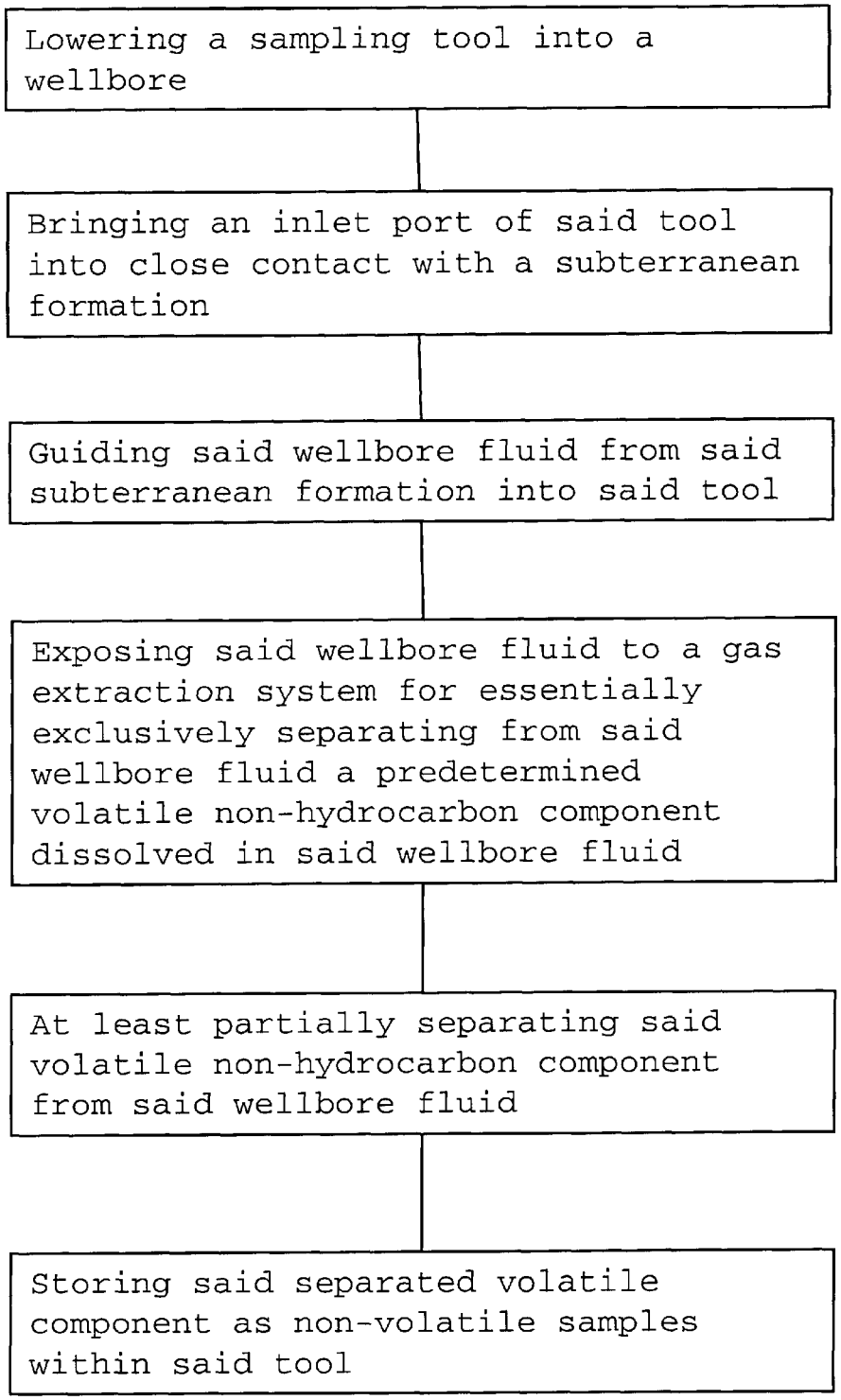

FIG. 1 shows a schematic diagram of sampling apparatus with a gas extraction system comprising binding material in accordance with the invention when in position downhole FIG. 2 shows an enlarged fragmentary view of the sampling apparatus depicting a column containing binding material; and FIG. 3 illustrates major steps of a method of sampling downhole fluids in accordance with the invention.

MODE(S) FOR CARRYING OUT THE INVENTION

FIG. 1 shows sampling apparatus 10 held on a wireline 12 within a wellbore 14. The sampling apparatus 10 comprises a known modular dynamics tester as described in Trans. SPWLA 34th Ann. Logging Symp., Calgary, June 1993, paper ZZ, with this known tester adapted by introduction of a sampling column 16 which is shown in detail in FIG. 2. The modular dynamics tester comprises body 20 approximately 30 m long which contains a channel 22 passing along its length, a sampling bottle 24 around 0.3 m long attached to the channel 22 by conduit 26 in which sampling column 16 is placed. An optical fluid analyser 30 is within the lower part of the channel 22 and towards the upper end of the channel 22 a pump 32 is placed. Hydraulic arms 34 are attached external to the body 20 and carry a sample probe 36 for sampling fluid, about the base of which probe is an o-ring 40, or other seal.

Before completion of a well, the modular dynamics tester is lowered downhole on the wireline 12. When at the desired depth of a formation 42 which is to be sampled, the hydraulic arms 34 are extended until the sample probe 36 is pushed into and through a side wall 44 of the wellbore 14, and into the formation 42 which is to be analysed. The o-ring 40 at the base of the sample probe 36 forms a seal between the side of the wellbore 44 and the formation 42 into which the probe 36 is inserted and prevents the sample probe 36 from acquiring fluid directly from the borehole 14.

Once the sample probe 36 is inserted into the formation 42, an electrical signal is passed down the wireline 12 from the surface so as to start the pump 32 and to begin sampling of a sample of fluid from the formation 42.

As shown in FIG. 2, attached to channel 22 by conduit 26 is sampling column 16. This sampling column, or scrubber column, is a hollow cylinder 46 with sealed ends, into opposite ends of which an inlet port 50 and an outlet port 52 enter. Inlet port 50 leads from channel 22 into the scrubber column 16, with outlet port 52 leading from the scrubber column 16 into a pressurised sample chamber 24 of known fixed volume. Across the cross-sectional area of each port 50, 52, there extends an inert porous filter 54, 56, typically made from polytetrafluoroethylene (PTFE), and each port has an associated valve 60, 62 within the conduit.

The column 16 is packed with a binding material 64 in the form of a high surface area solid phase, such as particles of iron oxide $Fe_3O_4$, which reacts with hydrogen sulphide in the fluid hydrocarbon to produce an inert and non-volatile compound. All of the internal volume of the scrubber column 16 may be filled with the solid phase or alternatively a known partial volume of the scrubber column 16 can be filled with the binding material 64.

The particles may be composed of porous, high surface area forms of metals or metal oxides or inert polymer beads with a coating of very fine particles of metals or metal oxides. Suitable metals include Fe, Mo and Zn. Appropriate metal oxides include ZnO and $SnO_2$, and where appropriate the metal oxides can be doped. Suitable inert polymers include polyetherketone, polystyrene or polyethylene.

Other binding materials suitable for use in the gas extraction system downhole include materials of the form $R_1R_2XYR_3R_4$, where X and Y are carbon or nitrogen atoms and any two of the R groups contain electronegative groups, for example fumaronitrile, and also iron (III) EDTA complex in an aqueous alkaline solution.

The particles used in the scrubber column 16, whether metal, metal oxide, or coated polymer beads, have a diameter chosen so that the fluid flows freely through the scrubber column whilst ensuring efficient absorption of volatile components within the fluid. Thus typically the particles have a diameter in the range 0.1–1 mm, which ensures that in use there is no significant pressure drop across the column which would prevent ingress of fluid into the column.

In use, once the sample probe 36 is in position within the formation 42 and the pump 32 activated, fluid flows up channel 22. Optical fluid analysis is conducted on fluid within the channel 22 by analyser 30 and by opening valves 60, 62 a sample of fluid flows through the scrubber column 16 and into the closed sample chamber 24.

Within the scrubber column, the iron oxide particles are stable in the presence of water and hydrocarbons but react immediately and irreversibly with $H_2S$ dissolved in the fluid in accordance with the following equation:

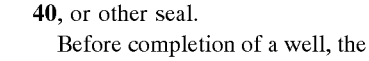

$$Fe_3O_4+6H_2S \rightarrow 3FeS_2+4H_2O+2H_2$$

so as to fix sulphur contained in $H_2S$ dissolved in the fluid as inert and non-volatile iron sulphide ($FeS_2$). The material within the scrubber column thus changes the form of the $H_2S$ and actively removes $H_2S$ from the fluid.

After filling the chamber 24 with fluid and so sampling a known volume of fluid, the tester 10 is raised to the surface on the wireline 14. The scrubber column 16 does not need to be sealed after use before raising to surface as the extracted sulphur is fixed in a non-volatile solid form and will not be lost on decompression at the surface.

The quantity of fluid sampled is known from the chamber volume and thus from the sulphur content of the stabilising material, the quantity of $H_2S$ per unit volume of hydrocarbon sampled can be readily calculated.

Once the tester 10 reaches the surface, the material within the scrubber column 16 and the fluid within the pressurised chamber 24 are analysed to determine their composition including the proportions of the various hydrocarbons present, their phase (pressure-volume-temperature or PVT) behaviour, density, viscosity and gas/oil ratio tests.

The sulphur content of the $Fe_3O_4$ in the scrubber column 16 is analysed to determine the hydrogen sulphide content of the hydrocarbon per unit volume of sampled hydrocarbon. Analysis of the sulphur content can occur by one of several laboratory analytical techniques. Since the sulphur has been fixed into a non-volatile form, its analysis does not present any significant problems. Any residual hydrocarbon on the metal sulphide is cleaned with an organic solvent, for example xylene, without the loss of sulphur. Pyrolysis of the metal sulphide to produce sulphur dioxide and detection by mass spectrometry allows the various sulphur isotopes to be identified.

If it is known that the metal sulphide and accompanying unreacted metal/metal oxide are free from contamination or impurities, then determination of the weight change of the sulphide on its pyrolysis to the oxide, for example zinc sulphide (ZnS) to zinc oxide (ZnO), will yield its sulphur content.

Gas chromatography combined with a mass spectrometer detector is another method that can be used for analysing the scrubber material as it readily identifies isotope ratios, such as the isotope ratio $^{34}S/^{32}S$. This allows comparison of organic/inorganic derived isotopes which is of use for geochemists and also in determining the geological history of formations.

Generally the described apparatus and method allow discrimination of $H_2S$ down to 1–100 ppm. However if the scrubber column becomes saturated with sulphur during sample acquisition, then the hydrogen sulphide content of the hydrocarbon sample may not be reliably determined.

Also the extraction of hydrogen sulphide from hydrocarbon samples using a scrubber column presupposes that its hydrogen sulphide content is relatively small, typically <0.5% or around 10 ppm, such as where the sulphur content of crude oils is in the range 0.3–0.8 weight percent and $H_2S$ content of natural gas is in the range 0.01–0.4 weight percent. For these weight percents the removal of $H_2S$ from the fluid sampled has no significant effect on its phase behaviour. However the phase behaviour of fluid samples which contain significant quantities of hydrogen sulphide, for example >5%, can be modified by removal of the $H_2S$. For example, removal of a high percentage of $H_2S$ from the fluid can alter the gas bubble point of phase analysis and in such samples the original composition of these hydrocarbon samples can be re-established by the addition of the correctly estimated quantity of hydrogen sulphide as enabled by the present invention prior to phase analysis.

The above steps are summarized and illustrated by FIG. 3.

What is claimed is:

1. A wellbore fluid sampling device comprising a main body to be suspended into a hydrocarbon well, said body having at least one fluid inlet port to engage with a wall of the well, at least one conduit guiding fluid into the main body and a gas extraction system associated with said at least one conduit for essentially exclusively separating from said wellbore fluid at least part of a predetermined volatile non-hydrocarbon component dissolved in said wellbore fluid entering said at least one conduit.

2. The sampling device according to claim 1 wherein the gas extraction system comprises a material capable of binding the volatile component.

3. The sampling device according to claim 2 wherein the binding material is tungsten oxide $WO_3$.

4. The sampling device according to claim 1 wherein the gas extraction system is placed within the conduit.

5. The sampling device according to claim 1 wherein the gas extraction system is placed in a supplementary chamber having an inlet and an outlet which is attached to the conduit.

6. The sampling device according to claim 1 wherein the gas extraction system is provided with filters located before and after the extraction system.

7. The sampling device according to claim 1 wherein the gas extraction system is selected so as to secure $H_2S$ in a nonvolatile form.

8. The sampling device according to claim 1 wherein the gas extraction system comprises iron oxide $Fe_3O_4$.

9. The sampling device according to claim 1 wherein the gas extraction system comprises a transition metal oxide.

10. The sampling device according to claim 1 wherein the gas extraction system comprises a doped transition metal oxide.

11. The sampling device according to claim 1 wherein the gas extraction system comprises an organic material.

12. The sampling device according to claim 1 wherein the gas extraction system comprises particulate material, so as to present a large surface area to the fluids to be sampled.

13. The sampling device according to claim 12 wherein the particles have a diameter in the range of 0.1 mm to 10 mm.

14. The sampling device according to claim 12 wherein the particles have a diameter in the range of 0.1 mm to 1 mm.

15. The sampling device according to claim 1 wherein the device further comprises attachment means to secure it to a wireline.

16. The sampling device according to claim 1 wherein the gas extraction system comprises an interface penetrable by the volatile component.

17. A method of sampling volatile components dissolved in wellbore fluids, comprising the steps of lowering a sampling tool into a wellbore; bringing an inlet port of said tool into close contact with a subterranean formation; guiding said wellbore fluid from said subterranean formation into said tool; exposing said wellbore fluid to a gas extraction system for essentially exclusively separating from said wellbore fluid a predetermined volatile non-hydrocarbon component dissolved in said wellbore fluid; at least partially separating said volatile non-hydrocarbon component from said wellbore fluid; and storing said separated volatile component as non-volatile samples within said tool.

18. The method according to claim 17, further comprising retrieving the non-volatile samples to surface after sampling to permit analysis of said samples.

* * * * *